US007600553B2

(12) United States Patent
Bresson

(10) Patent No.: US 7,600,553 B2
(45) Date of Patent: Oct. 13, 2009

(54) SAFETY DEVICE AND MECHANISM COMPRISING ONE SUCH DEVICE USED TO MANOEUVRE A CLOSING OR SUN PROTECTION INSTALLATION

(75) Inventor: Christophe Bresson, Cugney (FR)

(73) Assignee: SIMU, Arc les Gray (FR)

( * ) Notice: Subject to any disclaimer, the term of this patent is extended or adjusted under 35 U.S.C. 154(b) by 1 day.

(21) Appl. No.: 10/508,522

(22) PCT Filed: Mar. 27, 2003

(86) PCT No.: PCT/FR03/00971

§ 371 (c)(1),
(2), (4) Date: Sep. 21, 2004

(87) PCT Pub. No.: WO03/083246

PCT Pub. Date: Oct. 9, 2003

(65) Prior Publication Data

US 2005/0109473 A1 May 26, 2005

(30) Foreign Application Priority Data

Mar. 28, 2002 (FR) ..... 02 03942

(51) Int. Cl.
*E06B 9/84* (2006.01)

(52) U.S. Cl. ..... 160/301; 49/322

(58) Field of Classification Search ..... 160/302, 160/301, 191, 192, 305, 133, 300; 49/322, 49/200, 300; 188/82.7, 82.74, 82.77
See application file for complete search history.

(56) References Cited

U.S. PATENT DOCUMENTS

| | | | | |
|---|---|---|---|---|
| 2,878,865 | A | 3/1959 | Manley | |
| 3,637,004 | A * | 1/1972 | Wardlaw et al. | 160/133 |
| 3,842,892 | A * | 10/1974 | Stieler | 160/133 |
| 4,112,996 | A * | 9/1978 | Fohl | 160/296 |
| 4,125,142 | A * | 11/1978 | Fohl | 160/291 |
| 5,494,093 | A * | 2/1996 | Eiterman | 160/300 |
| 5,971,055 | A * | 10/1999 | Rohaut | 160/300 |
| 6,655,088 | B1 * | 12/2003 | Hormann | 49/200 |
| 6,862,845 | B2 * | 3/2005 | Schiks | 49/322 |
| 6,986,378 | B2 * | 1/2006 | Beaudoin et al. | 160/191 |

* cited by examiner

*Primary Examiner*—David Purol
(74) *Attorney, Agent, or Firm*—Dowell & Dowell, P.C.

(57) ABSTRACT

A safety mechanism for a closing installation, comprising a shaft and an element having teeth for cooperating with a catch which oscillates during rotational movements of the shaft. The mechanism further comprises a safety system including a ring for braking the oscillatory movement of the catch. The movement of the ring is controlled by a detecting system that detects the state of a spring which used to compensate the torque exerted on the shaft by the screen body.

32 Claims, 9 Drawing Sheets

SAFETY DEVICE AND MECHANISM COMPRISING ONE SUCH DEVICE USED TO MANOEUVRE A CLOSING OR SUN PROTECTION INSTALLATION

The invention relates to a safety device for a closing or sun-protection installation. The invention also relates to a mechanism for manoeuvring such an installation.

Closing installation is understood to mean doors, portals, shutters and equivalent equipment.

In a closing or sun-protection installation, it is known to use a winding mechanism for manoeuvring a screen body, a door, a shutter or equivalent. Such a mechanism may be actuated mechanically, thanks to a strap or a crank, or electrically, thanks to a motor which is most often of brake motor type. It is known to compensate the torque exerted on the winding mechanism by the weight of the screen body by means of one or more so-called compensating springs.

Furthermore, it is known to provide safety devices, sometimes called "anti-fall", to prevent the screen body from falling in the event of mechanical rupture in the kinematic chain controlling the screen body.

FR-A-2 242 010 describes a catch or rocking lever which comprises an arm capable of coming into engagement with an outer toothing of a wheel fast with a shaft for winding a screen body. This rocking lever comprises a second arm provided with a roller which forms counterweight for the first, while the roller rolls on undulations formed on the periphery of a second wheel, fast with the first. Gravity tends to apply the roller on the periphery of the second wheel, with the result that the first arm of the rocking lever oscillates between a position of engagement and of disengagement with respect to the teeth of the first wheel without, however, abutting thereagainst, this being effectively the case when the speed of rotation of the wheels is reduced. However, if the speed of these wheels increases, particularly in the case of the screen body falling, the roller no longer follows the peripheral undulations of the second wheel exactly, by reason of the inertia of the rocking lever and tends to remain detached from the second wheel, the first arm in that case being in position of engagement with the teeth of the first wheel and provoking a sudden blocking of the drive system.

Documents CH-A-573 146, DE-A-26 17 784 and DE-A-40 02 074 describe devices in which the peripheral toothing of a single wheel performs both a function of blockage and a function of undulation of a catch or of a rocking lever.

DE-A-29 15 547 provides replacing the teeth by rods which ensure both the undulation and the blocking of a catch. This device is active for braking the rotation of a winding shaft only beyond a certain speed of this shaft.

In the devices of the state of the art, a shock is produced, during blocking of the winding shaft, which is detrimental to the safety device itself and to the drive mechanism which it is supposed to protect. This involves dimensioning the parts constituting these safety devices accordingly, by using relative noble materials, or providing damping systems such as those envisaged in EP-A-0 671 543. This increases the cost price of this type of device and may increase their dimensions. In addition, in the so-called compensated installations, i.e. comprising compensating springs, a fall at reduced speed is possible, the devices of the prior art being in that case globally inefficient.

In effect, in this type of installations, it is possible to disengage the link between the drive motor and the shaft, such a disengagement making it possible to manoeuvre the screen body manually, for example in the absence of current supplying an electric motor. In the case of such a disengagement, there no longer exists a kinematic link between the motor and the screen body and only a correct equilibrium of the compensation prevents the screen body from falling. It is usual to adjust the compensation in dominant manner with respect to the weight of the screen bpdy in order to overcome the possible deficits of compensation which might occur in the life duration of the installation, particularly by reason of the running-in and inevitable wear of the parts. However, this is not sufficient to overcome the failure or an abnormal fatigue of a compensating spring, in which case the disequilibrium may be sufficiently great to create, at the instant of disengagement, a slow but dangerous fall of the screen body. Such a situation may occur in particular in the case of an installation comprising a plurality of compensating means, such as spring boxes, particularly in the case of rupture of one of the springs. Such a situation may also occur in the case of an installation comprising one sole compensating spring whose stiffness constant decreases with fatigue.

Such failures present an insidious nature, which renders them particularly dangerous. In effect, they do not appear when the installation is functioning normally, i.e. when the installation is manoeuvred by the motor, which is generally the case. As it is conventional to overdimension the motor and the structure in order to be able to absorb the hard spots and the variations of coefficient of friction which inevitably appear in the life of the installation, an insufficient equilibrium resulting from this type of failure is likewise concealed. It is only at the moment of disengagement, when a manual manoeuvring is needed, which occurs at an often unexpected instant, that the phenomenon appears.

Furthermore, it is known from U.S. Pat. No. 2,878,865 to couple a compensating spring to a catch which does not oscillate during the movements of lowering of a door. This non-oscillating catch blocks the descent of the screen body under the effect of a deficit between the torque produced by the compensating spring and that due to the weight of the door. Descent of a door equipped with such a mechanism is thus not manoeuvrable by a direct action on said door, which is in practice redhibitory as a door or a metal shutter of a shop must be able to be closed, including in the event of a power cut. In effect, a direct action to descend the door is detected by the mechanism as a deficit of compensation. In addition, as the blocking of the catch is obtained by a deficit of compensation, it is necessary that the compensating springs be overdimensioned in order that the efforts that they deploy always be greater than the effect of the weight of the lowering door, otherwise the movement of lowering of the screen body or of the shutter by the action of the motor induces successive blockages/unblockages of the catch which may, in the long run, damage the mechanism.

It is a more particular object of the invention to overcome these drawbacks by proposing a safety device for a closing or sun protection installation comprising an oscillating catch which functions correctly, including in the event of failure of a compensating means such as a spring.

In this spirit, the invention relates to a safety device for a closing or sun-protection installation comprising a mechanism for driving a means for closing an opening, this mechanism including a fast shaft and an element provided with a toothing adapted to cooperate with at least one catch which oscillates during rotational movement of said shaft and adapted to immobilize it in rotation. This device is characterized in that it comprises braking means or means for blocking the catch in its oscillatory movement, said braking or blocking means being controlled by means for detecting the state of a means for compensating the torque exerted on this shaft by the closing means.

Thanks to the invention, a failure of a compensating means such as a spring, and more particularly a rupture of such a spring, induces a braking of the oscillating catch, this making it possible to maintain it in position of blocking of the element provided with a toothing. This leads to an immediate immobilization of the shaft, without it being necessary for the shaft to have a predetermined speed of rotation. In other words, the braking means and the associated detection means make it possible to react immediately to a failure of the compensating means, before a substantial variation in speed of the rotating shaft, corresponding to a potentially dangerous displacement of the closure means, occurs. The device of the invention functions, in practice, thanks to a detection of the torque due to the compensating spring and not by the detection of a deficit of compensation. For the installations of compensated type, the device ensures dual protection, namely a protection at low speed, which is the case when the failure concerns the compensating means, and at high speed, which is the case for the other failures. In practice, it so happens that, in the compensated installations, the fall of the closing means, i.e. most often of the screen body, is most often the fact of a failure of the compensating means. Thanks to the invention, the life duration of the installation is maintained since, in the most frequent case, no shock is created when the safety device is activated. The device of the invention is also simpler, lighter, less expensive and less cumbersome than those of the state of the art.

According to advantageous aspects of the invention, this device incorporates one or more of the following characteristics:

The braking or blocking means comprise a shoe mobile axially with respect to the afore-mentioned shaft and adapted to come into abutment against the catch. This shoe advantageously bears at least one element in relief adapted to cooperate with a corresponding element in relief provided on a member fast in rotation with the compensating means, for controlling the axial position of the shoe with respect to the catch.

The elements in relief provided respectively on the aforementioned member and shoe may comprise ribs and grooves adapted to engage in one another. Such ribs and grooves make it possible, for example by a movement of screwing/unscrewing, to control the axial position of the shoe. In addition, at least certain of the afore-mentioned elements in relief may be provided to be formed on tongues extending through openings made in the element fast with the shaft.

The afore-mentioned shoe and member are advantageously disposed axially on either side of the element fast with the shaft, being kinematically connected by the cooperation of the aforementioned elements in relief. Means for applying an elastic effort of displacement of the shoe towards the catch may be provided. In that case, the member and the element fast with the shaft are advantageously provided with ribs between which at least one compression spring is disposed, exerting a rotational torque of the member fast with the compensating means with respect to the element fast with the shaft.

The shoe is a ring disposed inside the shaft and around an element forming support and/or motorization assembly for the mechanism.

The braking or blocking means are adapted to displace or tip the catch towards a braked or blocked position. In that case, there may be provided a friction pellet, mounted on the catch or thereopposite, and intended to receive the catch in abutment or to come into contact with a bearing surface. Furthermore, the braking or blocking means may comprise a surface formed on a part fast in rotation with the compensating means and intended to exert, directly or indirectly, an effort of displacement or of tipping on the catch. This surface may extend in a direction substantially inclined with respect to an axis of rotation of the shaft, this surface in that case forming a ramp adapted to displace the catch towards its braked or blocked position. This surface may also be substantially radial with respect to an axis of rotation of the shaft and be adapted to cooperate with a finger of the catch in order to tip it about its oscillation axis, towards a braked or blocked position by engagement with the toothing. Means for returning the catch opposite the braked or blocked position may be provided. The braking or blocking means may also comprise at least one shuttle adapted to displace the catch in the direction of a fixed blocking toothing. In that case, this shuttle is advantageously provided with an elastic means for adjusting its length, taken between a bearing surface and the catch. In addition, means may be provided for elastic return of the braking or blocking means towards a position in which they exert on the catch an effort of displacement or of tipping towards the braked or blocked position.

The catch may be mounted on a fixed element of the installation or, on the contrary, on an element fast in rotation with the shaft, being intended to be driven in rotation thereby.

The braking or blocking means, the detection means and the compensating means are arranged around an element forming support and/or motorization assembly for the mechanism.

According to a first form of embodiment of the invention, the compensating means is a spring tightened around an end support of the shaft, between a part fixed with respect to the support and an annular member adapted to rotate thereabout by being driven by the shaft, the catch being mounted to pivot about a pin fixed with respect to the support.

According to a second embodiment of the invention, the compensating means is a spring tightened by a weight and fast with an annular member surrounding an end support of the shaft, the catch being mounted to pivot about a pin fixed with respect to this support.

According to a third embodiment of the invention, the compensating means is a spring tightened around a motorization assembly disposed inside the shaft, the catch being mounted to pivot about a pin fixed with respect to a part forming end support of this shaft.

According to a fourth embodiment of the invention, the compensating means is a spring integrated in a spring box disposed inside the shaft, between the latter and a fixed shaft, the spring box also comprising the catch, the braking means and the detection means.

The invention also relates to a mechanism for manoeuvring a closing or sun protection installation which comprises a safety device as described hereinabove. Such a mechanism is more reliable, more compact and less expensive than those of the state of the art. In particular, it is secured against a failure of a compensating spring.

The invention will be more readily understood and other advantages thereof will appear more clearly in the light of the following description of seven forms of embodiment of a maneouvring mechanism equipped with a safety device in accordance with its principle, given solely by way of example and made with reference to the accompanying drawings, in which.

Figure 1:
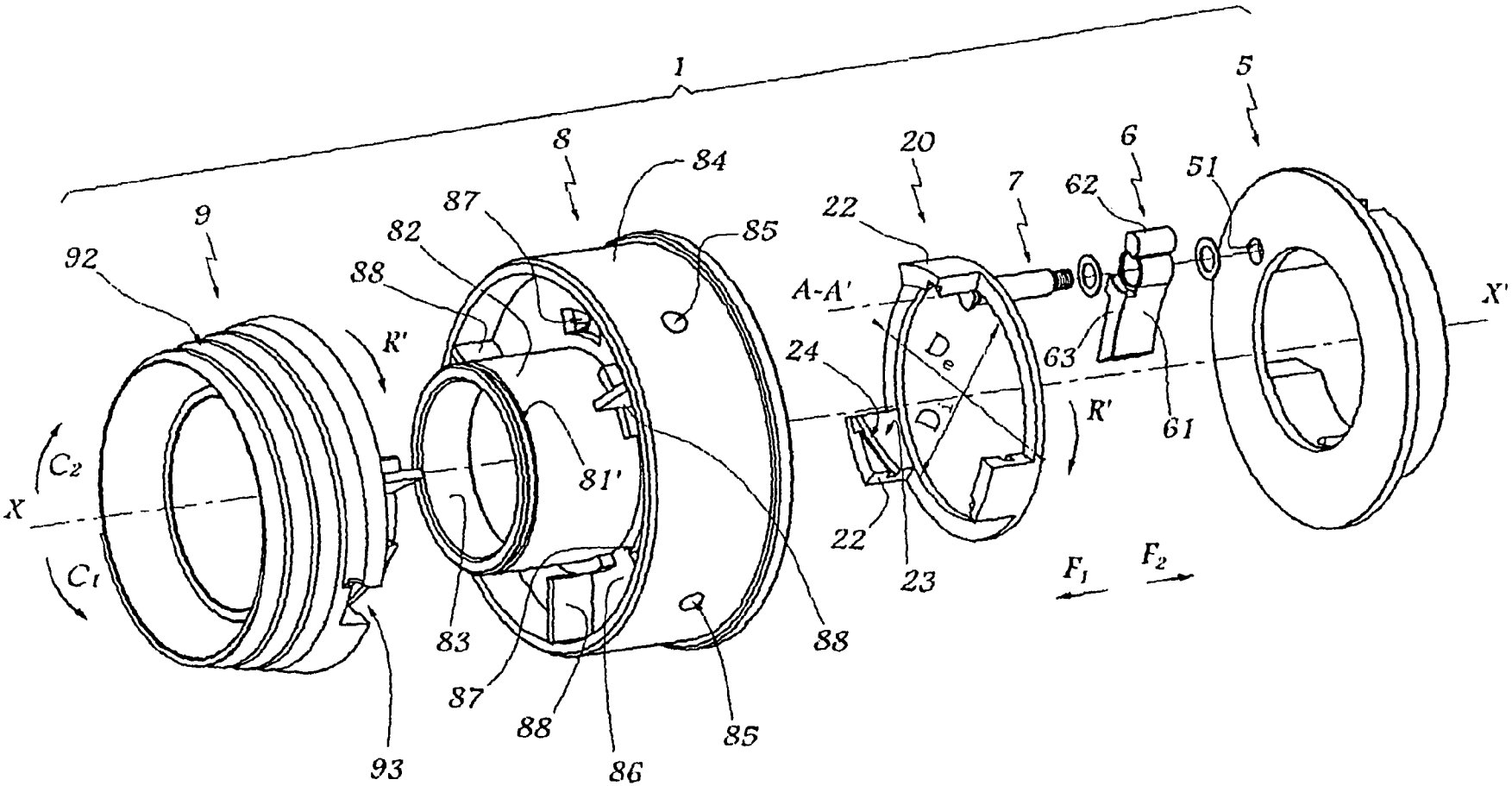
FIG. 1 is a view in perspective of certain elements constituting a mechanism according to the invention.
Figure 2:
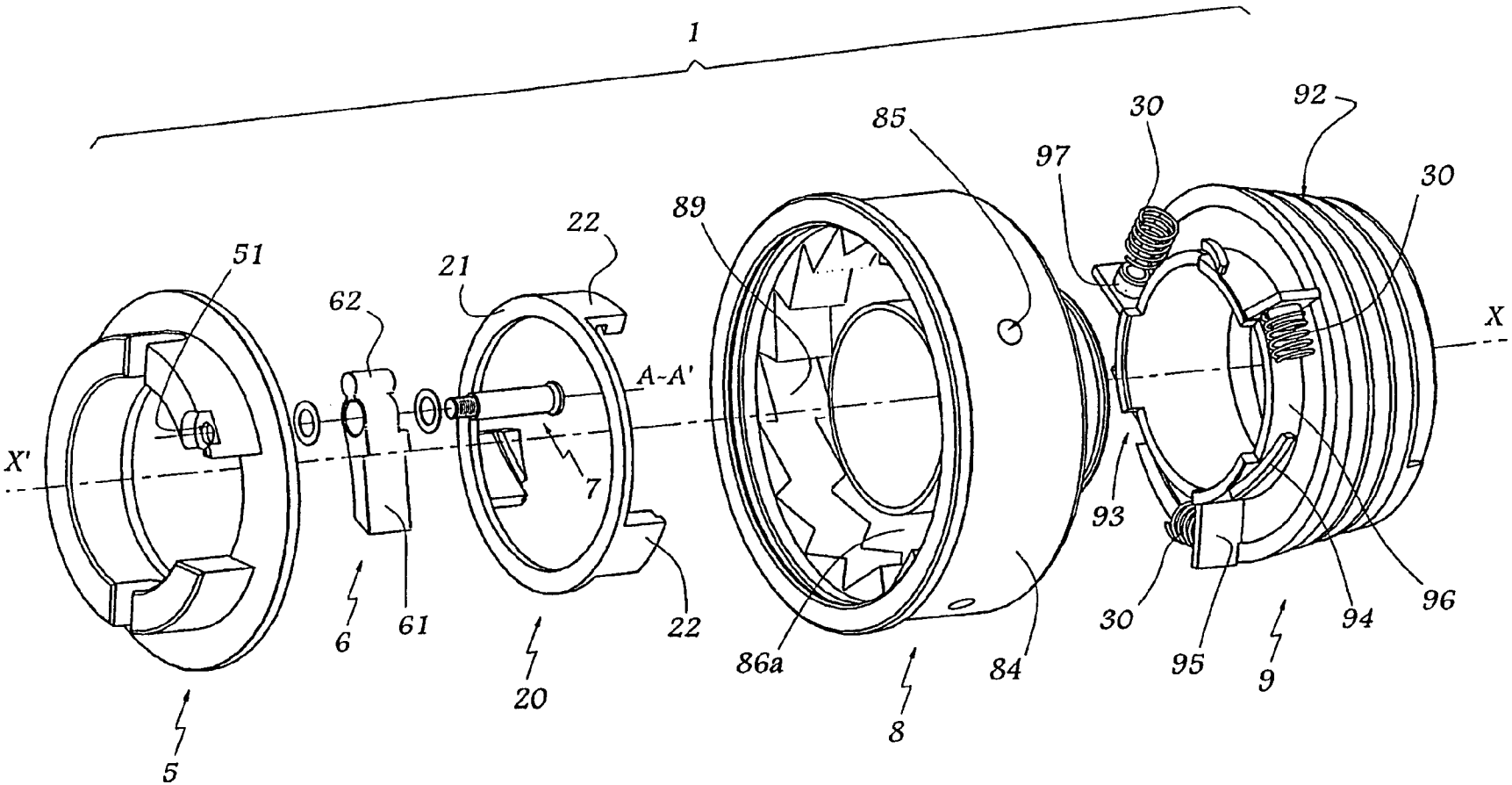
FIG. 2 is a view in perspective of the elements of FIG. 1, seen from another angle.
Figure 3:
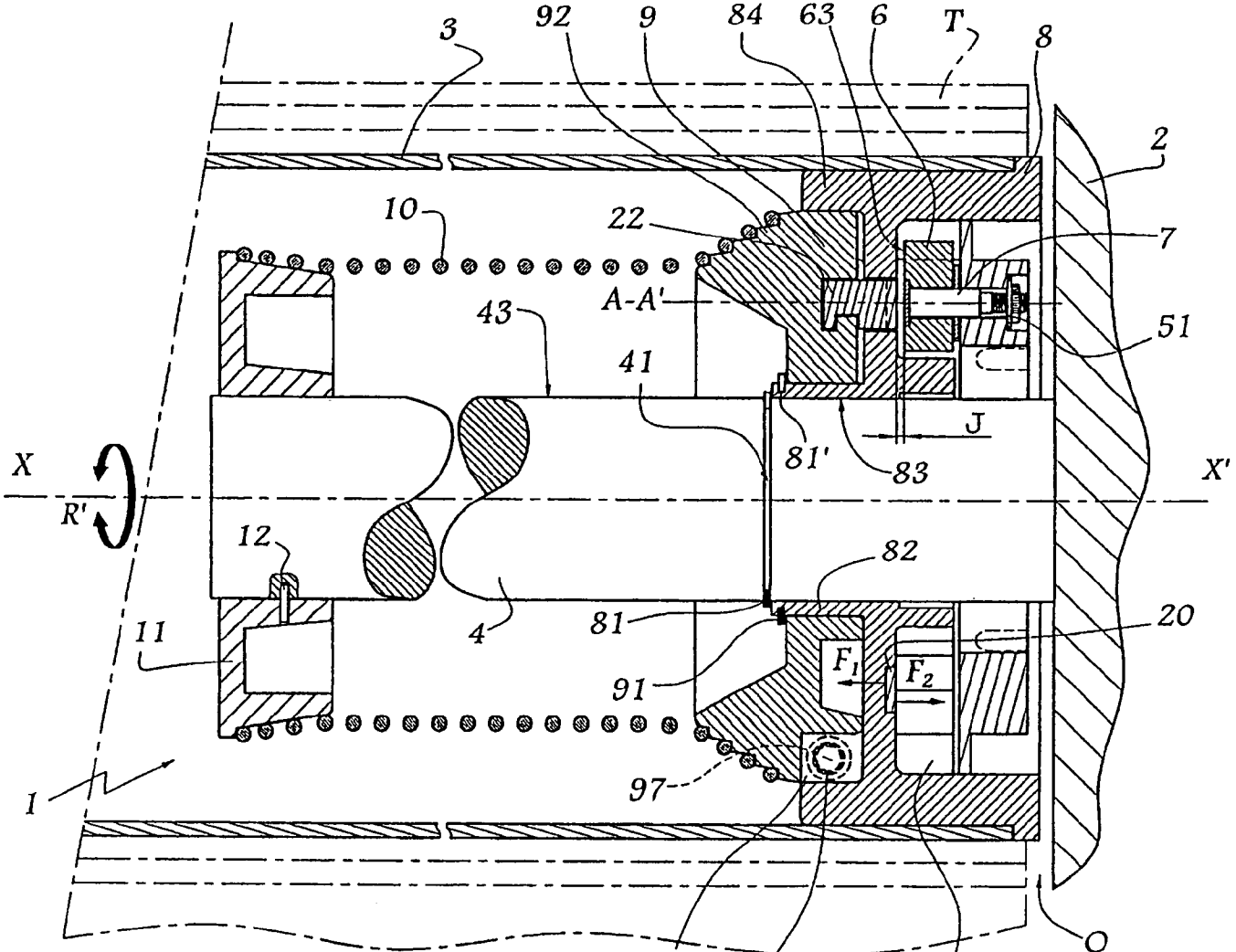
FIG. 3 is a partial section of a mechanism according to the invention incorporating the elements shown in FIGS. 1 and 2.

The mechanism 1 shown partially in FIGS. 1 to 3 is provided for the controlled winding, about a substantially horizontal axis X-X', of a screen body T allowing an opening O provided in a building to be selectively closed. This mechanism is intended to be supported with respect to the masonry of a building, by means of a bracket 2 possibly integrated in a tunnel box.

The mechanism 1 comprises a tubular shaft 3 of circular section and whose longitudinal axis merges with axis X-X'. The shaft 3 might present a polygonal cross-section or another profile.

A support 4, fixed by any appropriate means on the bracket 2, is disposed inside the tube 3 and is equipped with an annular ring 5 which surrounds the support 4 being immobilized thereon in rotation and in translation. The ring 5 is therefore fixed with respect to the masonry of the building.

A catch 6 is mounted on a mechanical pin 7 passing through an opening 51 in the ring 5. A-A' denotes the geometrical axis of symmetry of the shaft 7. Axes X-X' and A-A' are substantially parallel.

The catch 6 comprises a first branch 61 extending radially with respect to the axis A-A' when the catch 6 is mounted on the pin 7 and a second branch 62.

A ring 8 is also mounted about the support 4 and axially immobilized with respect thereto thanks to a snap ring 81 engaged in a groove 41 of the support 4. The ring 8 is fast in rotation with the shaft 3.

The ring 8 comprises an inner sleeve 82 defining a cylindrical surface 83 with circular base of radius substantially equal to the outer radial surface 43 of the support 4, with the result that the ring 8 may rotate about axis X-X' by sliding over the surface 43.

The ring 8 also comprises an outer sleeve 84 provided with bores 85 for passage of screws (not shown) making it possible to connect the ring 8 and the shaft 3 in rotation and in translation.

An annular web 86 joins the sleeves 82 and 84 and is pierced with three openings 87.

Three ribs 88, which are radial and substantially planar, are also provided between the sleeves 82 and 84, being perpendicular to the web 86.

An inclined toothing 89 is arranged inside the sleeve 84. This toothing is oriented and dimensioned in order to cooperate, if necessary, with the branch 62 of the catch 6.

An annular member 9 is provided to be mounted about the sleeve 82, being maintained axially by a snap ring 91 engaged in a groove 81' of the ring 81. The outer surface 92 of the annular member 9 is substantially truncated and stepped. The surface 92 is also provided with a notch 93 for receiving and wedging a first end of a compensating spring 10 of which the part nearest this end is wound on the surface 92.

The opposite end of the spring 10 is immobilized on a ring 11 whose outer shape is likewise truncated, itself immobilized on the support 4 thanks to a lug 12.

A motorization assembly (not shown), which may be electrical or mechanical and disposed near the opposite end of the shaft 3, makes it possible to drive the shaft 3 in rotation about axis X-X', as represented by the double arrow R in FIG. 3.

The annular member 9 is provided with ribs 95 each extending in a radial direction with respect to a central sleeve 96 and provided with a lug 97 for centering a compression spring 30 intended to be housed between a rib 95 and a rib 88 which are opposite when the annular member 9 is mounted on the ring 8, as shown in FIG. 3.

As a function of the position of the screen body T with respect to the opening O, the compensating spring 10 is more or less tightened between the annular member 9 and the ring 11. In effect, the shaft 3 drives in rotation the ring 8 which drives, by the cooperation of the ribs 88 and 95, the annular member 9. As a function of the direction of rotation of the annular member 9 about the axis X-X', the tension of the spring 10 increases or decreases.

During the movements of rotation of the shaft 3 about axis X-X' for winding or unwinding the screen body T, the catch 6 oscillates about axis A-A', this movement of oscillations being generated by the successive contacts between the branch 62 and the teeth of the toothing 89 and by the effect of the weight of the branch 61 which is heavier than the branch 62.

In this embodiment and in the following ones, the catch 6 or equivalent is of non-blocking type by default. It becomes blocking under the effect of the centrifugal force upon a rapid rotation of the shaft 3 or equivalent when the screen body T unwinds.

A ring 20 is interposed between the ring 5 and the face 86*a* of the web 86 turned towards the ring 5. In fact, the ring 20 is interposed between the face 86*a* and the catch 6. The ring 20 has such inner ($D_i$) and outer ($D_e$) diameters that its face 21 turned towards the catch 6 is substantially aligned with a lateral face 63 of this catch.

In this way, as a function of its axial position, i.e. its position along the axis X-X', the ring 20 is capable of coming into abutment against the catch 6.

The ring 20 is provided with three tongues 22 dimensioned to be engaged in the openings 87 of the ring 8 and each provided, on their face 23 turned towards axis X-X', with a groove 24 in the form of a portion of helix.

The annular member 9 is provided with three helicoidal ribs 94 dimensioned and arranged so that they may be engaged in the grooves 24 of the ring 20.

The angle of inclination of the elements 94 and 24 with respect to axis X-X' is such that the elements 94 and 24 perform the role of threads making it possible to "screw" the ring 20 on the annular member 9 in the direction represented by arrow R' in FIG. 1.

Functioning is as follows:

When the spring 10 performs its role of compensation efficiently, it exerts on the annular member 9 a torque $C_1$ directed in a direction such that it tends to cause the ribs 94 to advance in the grooves 24 in a sense of screwing the ring 20 on the annular member 9. Under these conditions, the ring 20 is drawn towards the web 86, this being represented by the effort $F_1$ in FIGS. 1 and 3.

In this way, a clearance J is formed between the ring 20 and the lateral face 63 of the catch 6.

In the event of rupture or of failure of the spring 10, the torque $C_1$ is cancelled or overcome by a torque $C_2$ exerted in opposite direction by the springs 30, this having the effect of rotating the annular member 9 about axis X-X' in the direction of arrow R' in FIG. 1. This induces an effort of displacement of the ring 20 in the direction of the catch 6, this effort being represented by arrow $F_2$ in FIGS. 1 and 3.

It will be noted that the torque $C_2$ has a relatively low value with respect to the torque $C_1$. The value of the stiffness constants of the springs 30 is chosen to that end as a function of that of the spring 10. In this way, braking or blocking of the catch 6 is obtained in the event of total or virtually total failure of the spring 10 and not in the case of momentary under-compensation due, for example, to a variation of the diameter of winding of the screen body, as might occur in a device functioning on the basis of a deficit of compensation. These comments are also applicable, against possible adaptations, to the other forms of embodiment.

In that case, the ring 20 performs the role of a shoe for braking the catch 6, as its face 21 comes into contact with the lateral face 63 of this catch.

In this way, a failure or a rupture of the spring 10 is detected thanks to elements 8, 9 and 30 and such detection makes it possible to control the translation of the ring 20 in the direction of the catch 6 that the ring forming shoe can efficiently brake in its movement with respect to the toothing 89. By being braked, the catch 6 is blocked in engagement in the toothing 89 and thus immobilizes the annular member 8 with respect to the ring 5, i.e. the shaft 3 with respect to the support 4 and to the bracket 2.

In that case, the screen body T no longer risks falling accidentally.

Figure 4:
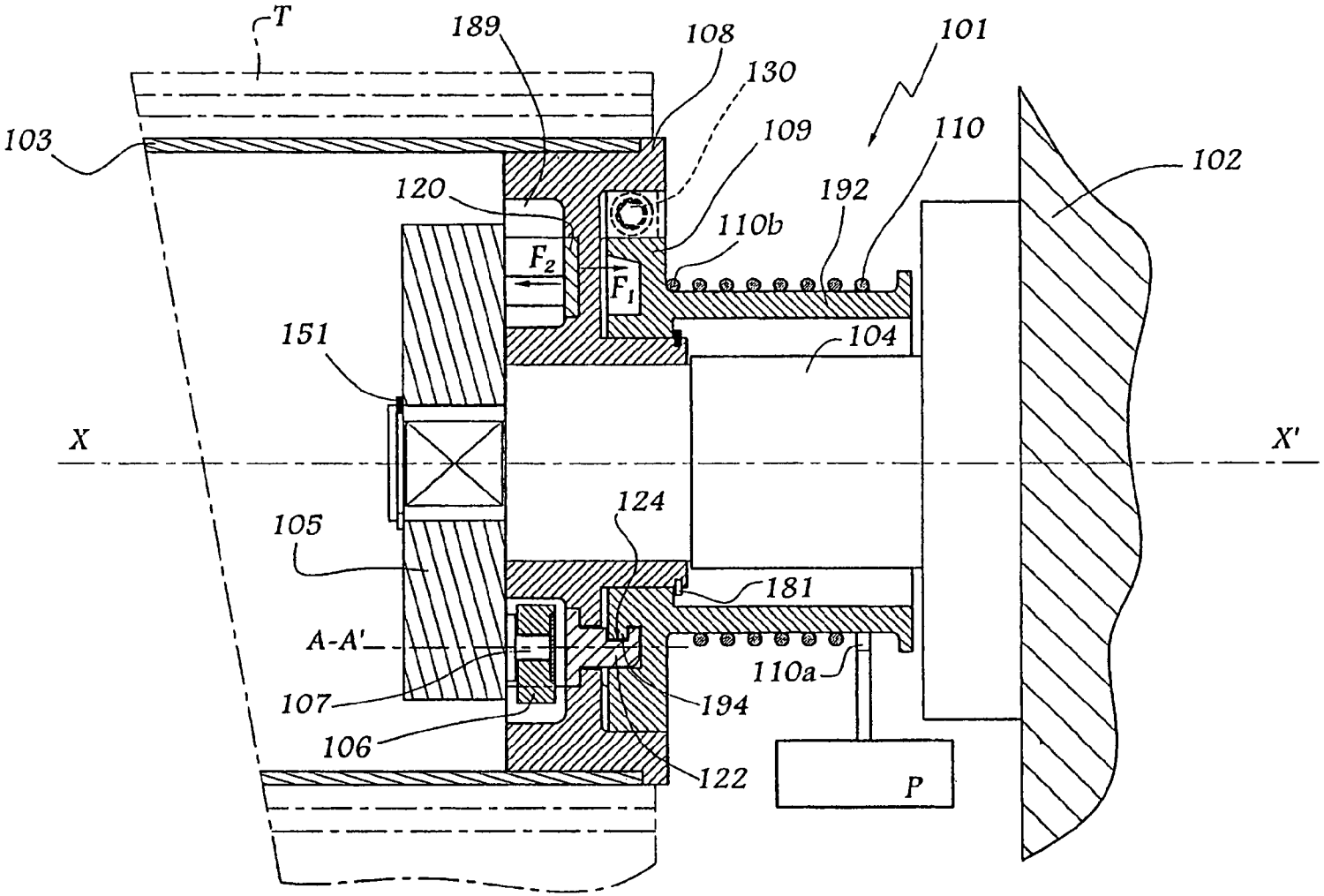
FIG. 4 is a view similar to FIG. 3 for a mechanism in accordance with a second form of embodiment of the invention.

In the second form of embodiment of the invention shown in FIG. 4, elements similar to those of the first bear identical references increased by 100. The mechanism 101 of this embodiment is provided for winding a screen body T and comprises a shaft 103 mounted on a ring 108, itself supported by a support 104 immobilized with respect to a bracket 102 fixed with respect to the masonry of a building.

A ring 105 is mounted at the end of the support 104 and immobilized axially thanks to a snap ring 151 and in rotation by cooperation of shapes.

The ring 105 supports a mechanical pin 107 of which A-A' denotes the geometrical axis, while X-X' denotes the geometrical axis of the tube 103 which is also its axis of rotation. Axes A-A' and X-x' are substantially parallel.

An annular member 109 is arranged on the ring 108 and immobilized axially, with possibility of rotation, thanks to a snap ring 181. The annular member 109 extends axially by a sleeve 192. Around this sleeve 192, there is wound a cable 110 from which a weight P is suspended.

As previously, a ring 120 is equipped with tongues 122 provided with grooves 124 for receiving ribs 194 made on the ring 109, the cooperation of the elements 124 and 194 making it possible to exert on the ring 120 efforts $F_1$ and $F_2$ of translation parallel to axes A-A' and X-X', which allows the ring 120 to selectively brake a catch 106 mounted on the pin 107.

The effort $F_1$ is generated by the weight P, while the effort $F_2$ is generated by springs 130 interposed between ribs belonging respectively to the ring 108 and to the ring 109.

A failure of the means supporting the weight P, particularly a rupture of the cable 110, has the effect of rotating the ring 109 about axis X-X'. As in the previous embodiment, this induces a displacement of the ring 120 in the direction of the catch 106, the ring blocking the catch in engagement in the toothing 189. This results in the ring 108 and the tube 103 being immobilized in rotation with respect to the ring 105 and to the support 104.

Like in the first embodiment, a mechanism for driving the shaft 103 in rotation may be provided at the opposite end of this shaft.

Figure 5:
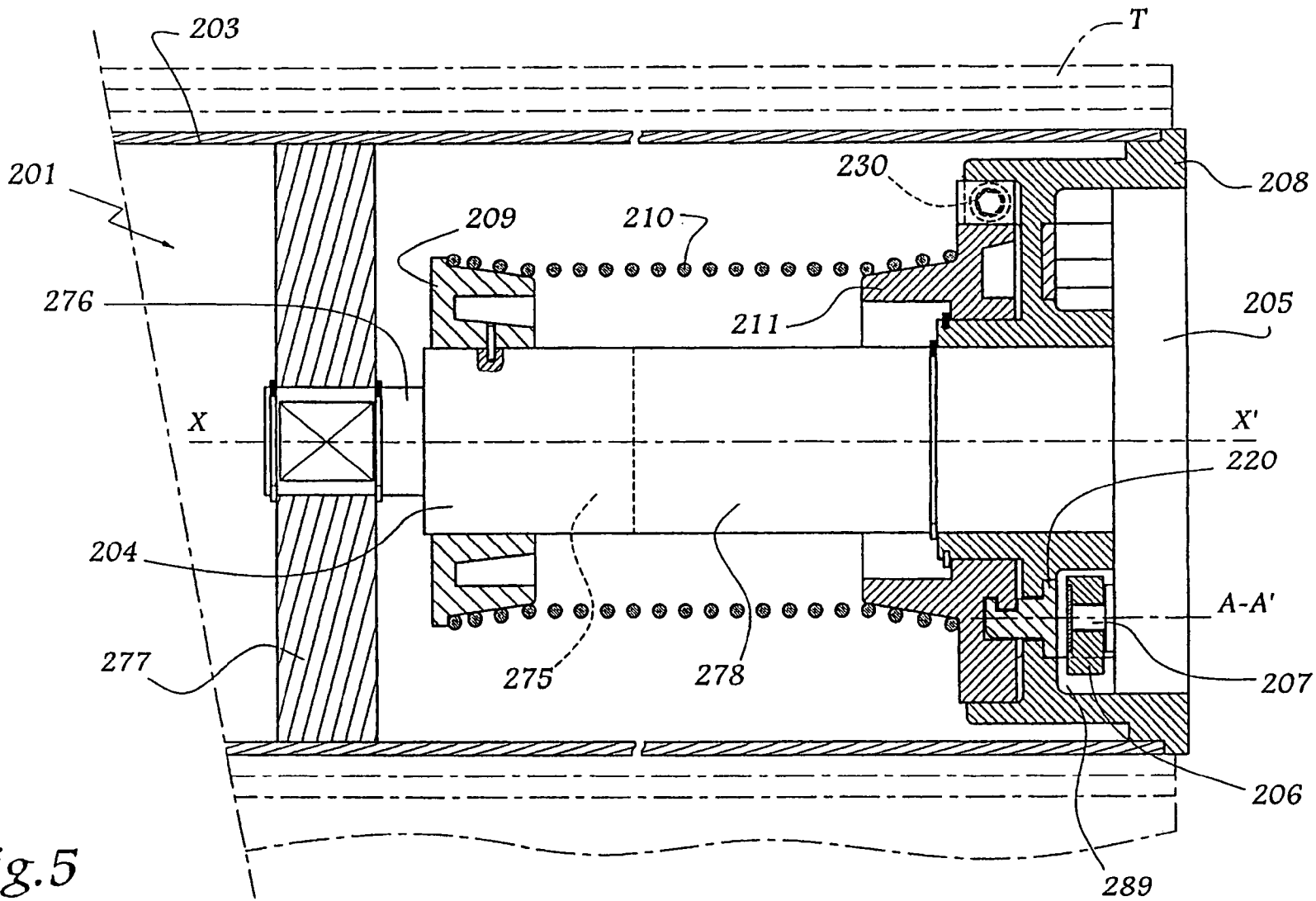
FIG. 5 is a view similar to FIG. 3 for a mechanism in accordance with a third embodiment of the invention.

In the third form of embodiment of the invention shown in FIG. 5, elements similar to those of the first embodiment bear identical references increased by 200. The mechanism 201 of this embodiment is provided for the controlled winding of a screen body T around an axis X-X' which is also the axis of symmetry of a shaft 203. Around axis X-X' there are disposed a ring 208, an annular member 209, a catch 206, a ring 220 and springs 230. A compensating spring 210 is tightened between the ring 209 and a ring 211 also centred on axis X-X'.

This embodiment differs from the preceding ones in that an electric motor 275 is integrated in the support 204 of the shaft 203 and of the afore-mentioned elements. 276 denotes the output shaft of the motor 275, this shaft being fast in rotation with a disc 277 for driving the shaft 203 in rotation.

The outer casing 278 of the motor 275 has substantially the same geometry as the support 4 of the first embodiment.

The catch 206 is articulated about a pin 207 fixed on a part 205 in one piece with the support 204.

This embodiment presents the particular advantage that all the functions of motorization, of compensation and of safety of the mechanism 201 are grouped together in a compact device which may be pre-assembled in the factory, before it is placed in position inside an end of the shaft 203.

Figure 6:
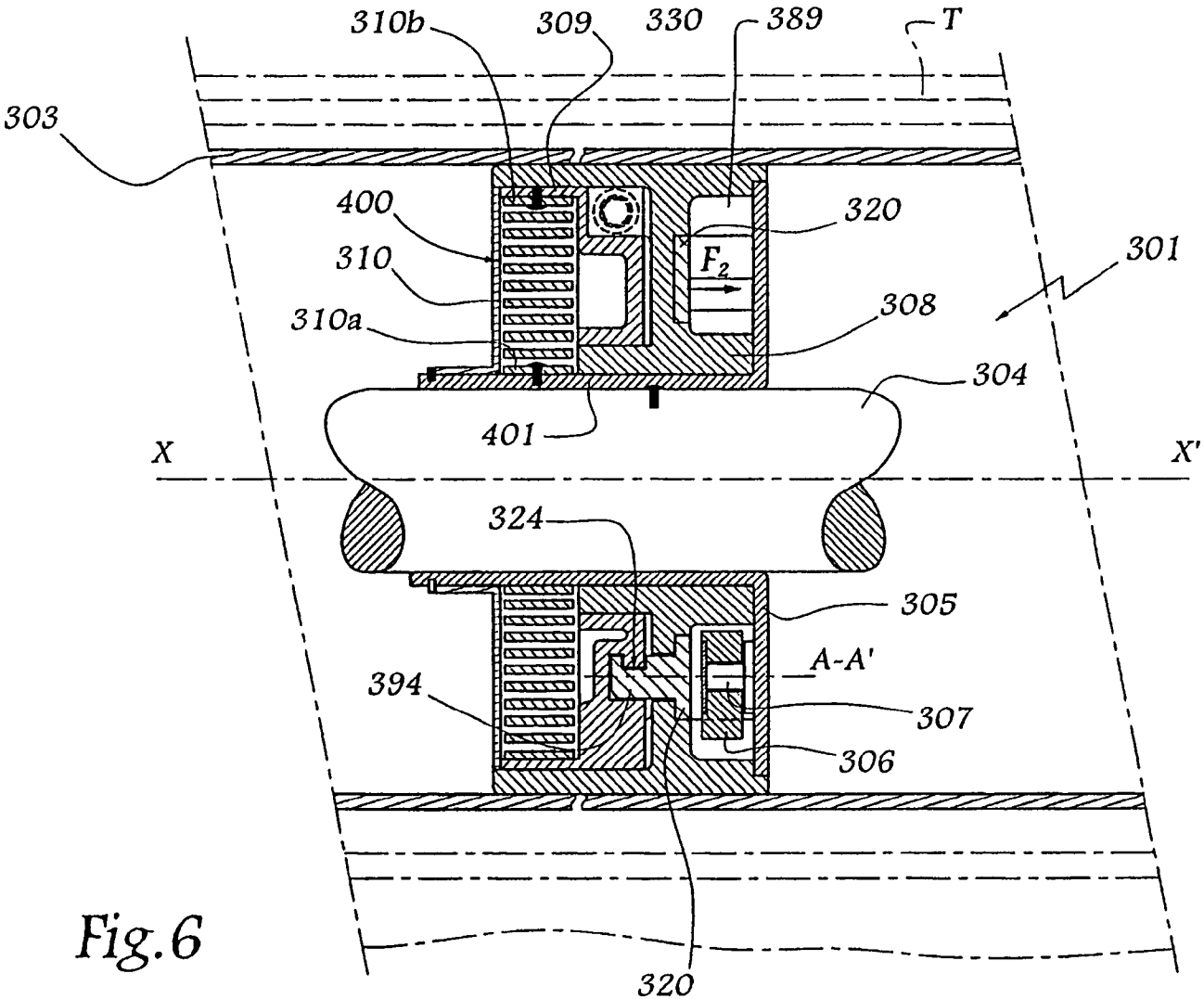
FIG. 6 is a view similar to FIG. 3 for a mechanism in accordance with a fourth embodiment of the invention.
Figure 7:
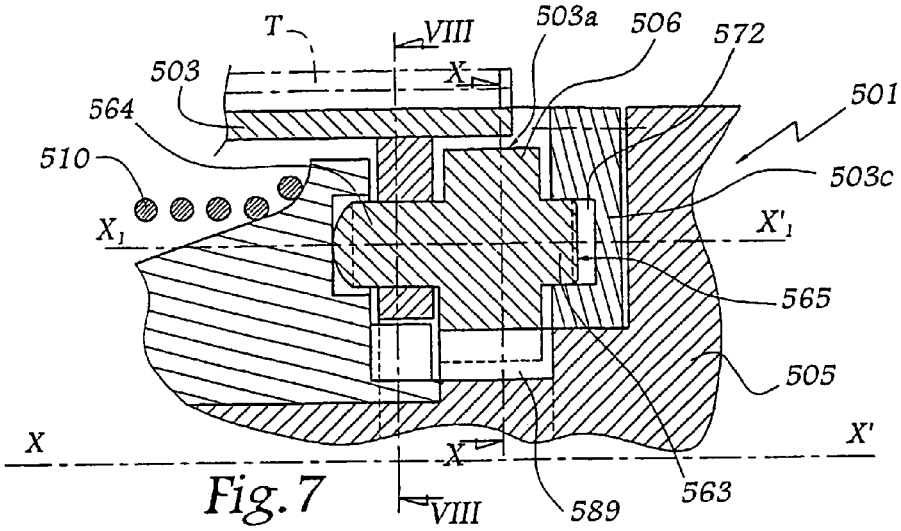
FIG. 7 is a partial section through a mechanism in accordance with a fifth embodiment of the invention.

In the fourth form of embodiment of the invention shown in FIG. 6, elements similar to those of the first embodiment bear identical references increased by 300. The mechanism 301 of this embodiment comprises a tube 303 for the controlled winding of a screen body T about an axis X-X' which is also the axis of symmetry of the tube 303.

A fixed shaft 304 extends inside the shaft 303 and a spring box 400 is interposed between the shafts 303 and 304. This spring box comprises a compensating spring 310 of which one end 310*a* is fast with an inner radial part 401 of the box 400 and of which the other end 310*b* is fast with an annular element 309 mounted, with possibility of rotation, on a ring 308, itself fast with the shaft 303. As previously, a ring 320 constitutes a shoe capable of braking a catch 306 supported by a mechanical pin 307 fast with a lateral partition 305 of the spring box 400, this lateral partition being, in practice, in one piece with the part 401 which is fixed with respect to the shaft 304.

Springs 330 make it possible to exert on the annular part 309 an effort transmitted by a rib 394 to a groove 324 of the ring 320 and tending to apply the ring 320 against the catch 306, as represented by the arrow of effort $F_2$. When the spring 310 correctly ensures its function of compensation, the effort exerted by the springs 330 is overcome by the spring 310, with the result that the ring 320 is maintained at a distance from the catch 306 by maintaining a clearance J, as represented by the arrow of effort F.

The geometry of the grooves 24 and of the ribs 94 or of the equivalent elements of the second, third and fourth embodiments, is not necessarily helicoidal.

The rings 108, 208 and 308 of the second, third and fourth embodiments are respectively provided with toothings 189, 289 and 389 similar to the toothing 89 of the first embodiment.

In the fifth form of embodiment of the invention shown in FIGS. 7 to 10, elements similar to those of the first embodiment bear identical references increased by 500. In this mechanism 501, a winding shaft 503 is provided to rotate about an axis X-X' to allow the controlled winding of a screen body T. A ring 505 is fixed by a bracket (not shown) to the masonry of a building. A catch 506 is fast, in rotation about axis X-X', with the shaft 503 which defines a housing 503*a* for receiving the catch 506. The catch 506 is provided with two branches 561 and 562 and with a central body 563.

The branch 561 is adapted to cooperate with an inclined toothing 589 formed on the periphery of the ring 505.

Figure 10:
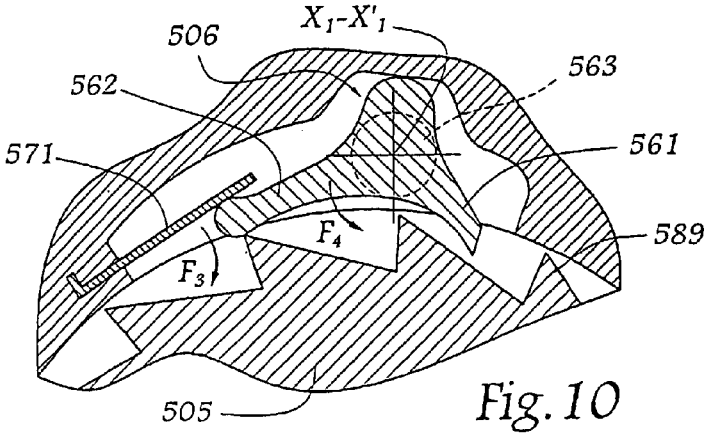
FIG. 10 is a section along line X-X in FIG. 7.

A spring blade 571 exerts on the branch 562 an effort $F_3$ intended to induce a pivoting of the catch 562 about its axis $X_1$-$X'_1$ of articulation on the shaft 503 in the direction of arrow $F_4$ in FIG. 10, this having the effect of moving the branch 561 away from the toothing 589.

Axes X-X' and $X_1$-$X'_1$ are substantially parallel.

The branches 561 and 562 are substantially balanced, this allowing the catch 506 to function efficiently, as mentioned with reference to the catches of the previous embodiments, independently of the orientation of the shaft 503 about axis X-X'.

A compensating ring 510 is provided in the installation and is blocked on a ring 509, itself mounted to pivot about the ring 505. The ring 509 is provided with a radial extension 591 intended to penetrate in a notch 503*b* made in the shaft 503, a spring 530 being interposed between the extension 591 and one of the sides of the notch 503*b*. This spring exerts on the extension 591 an elastic effort $F_5$ oriented towards the left in FIG. 8.

Figure 8:
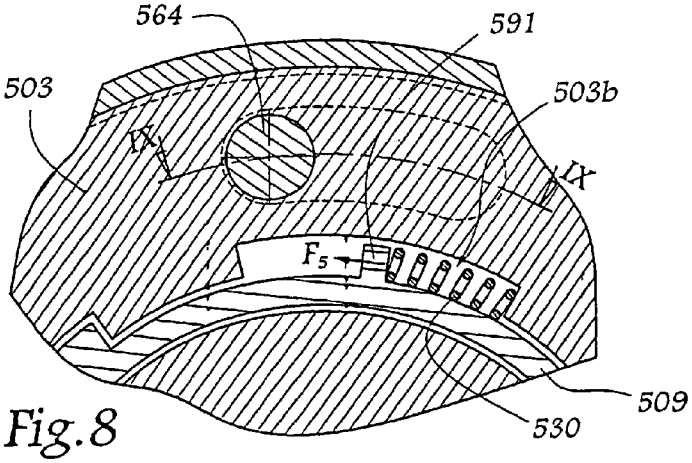
FIG. 8 is a section along line VIII-VIII in FIG. 7.
Figure 9:
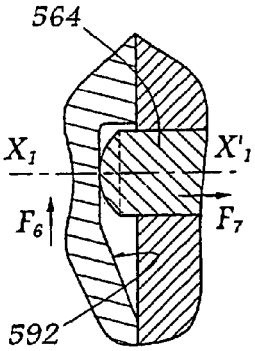
FIG. 9 is a section along line IX-IX in FIG. 8.

In the event of rupture of the spring 510, the effort $F_5$ has the effect of displacing the ring 509 with respect to the shaft 503 towards the left in FIG. 8 and upwardly in FIG. 9, this having the effect of bringing a surface 592 made on the ring 509 into abutment against an end finger 564 of the catch 506.

The surface 592 is inclined with respect to the axis $X_1$-X'L and with respect to the axis X-X', with the result that the displacement of the ring 509 under the effort $F_5$, which displacement is represented by arrow $F_6$ in FIG. 9, has the effect of pushing the finger 564 and the catch 506 assembly in the direction of arrow $F_7$.

This has the effect of bringing the rear face 565 of the catch 506 into contact with a friction pellet 572. The contact between the face 565 and the pellet 572 brakes the oscillations of the catch 506 around the axis $X_1$-$X'_1$, with the result that a rapid and efficient blocking is obtained of the catch 506 with respect to the toothing 589, i.e. an immobilization in rotation of the shaft 503.

According to a variant of the invention (not shown), the pellet 572 might be mounted on the catch 506, in which case it would be displaced with the catch in the direction of a lateral face 503*c* of the shaft 503.

Figure 11:
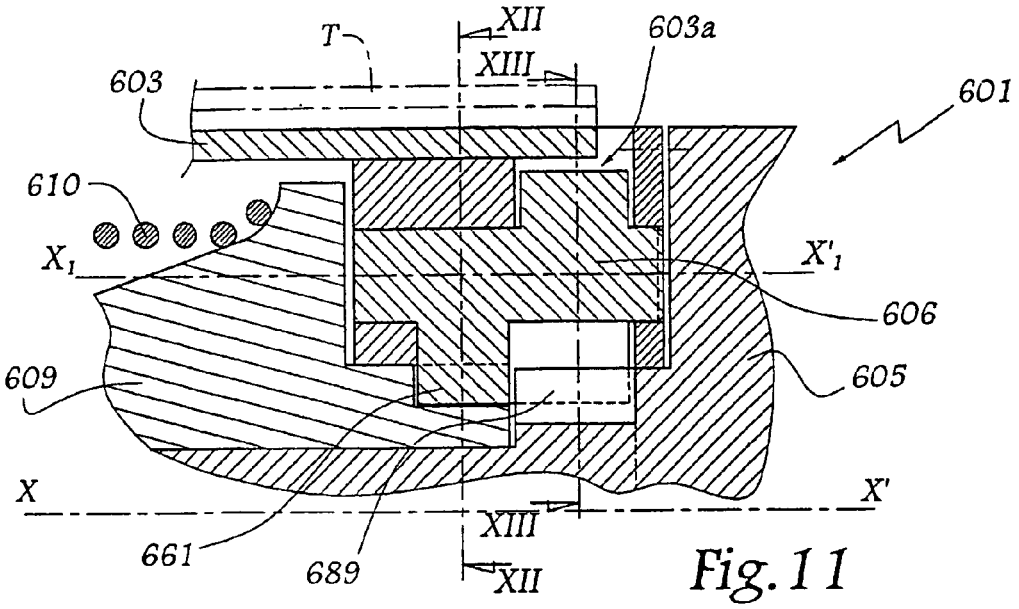
FIG. 11 is a section similar to FIG. 7 for a mechanism in accordance with a sixth embodiment of the invention.
Figure 12:
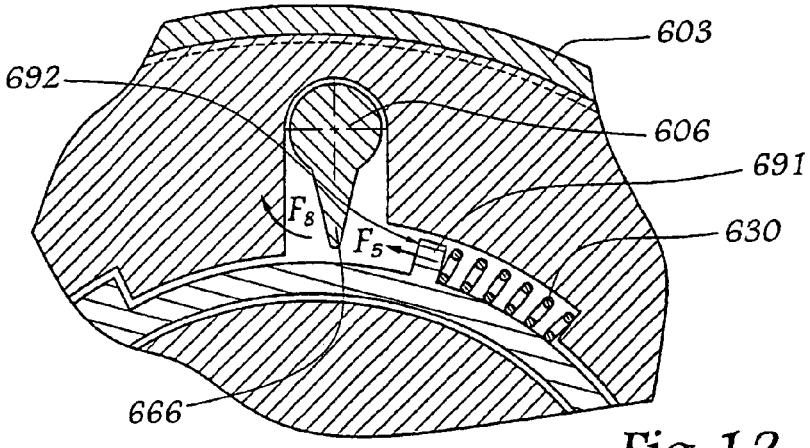
FIG. 12 is a section along line XII-XII in FIG. 11.
Figure 13:
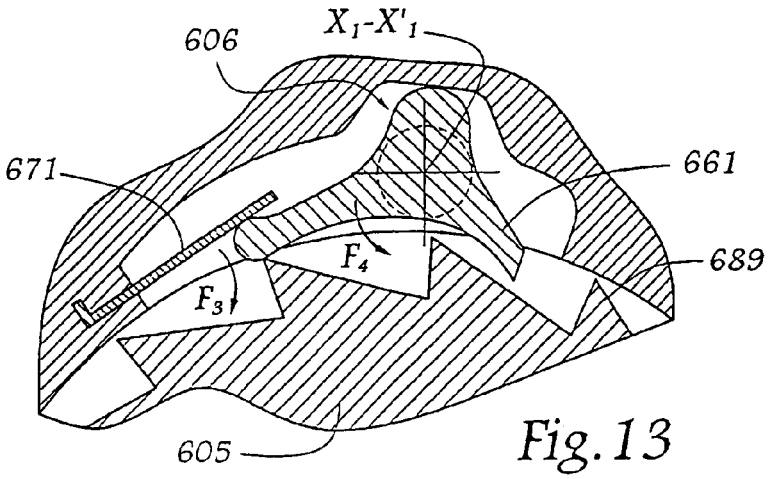
FIG. 13 is a section along line XIII-XIII in FIG. 11.

In the sixth form of embodiment shown in FIGS. 11 to 13, elements similar to those of the first embodiment bear identical references increased by 600. The mechanism 601 of this embodiment differs from the preceding one in that, in the event of rupture of the compensating spring 610, the ring 609 fast with the compensating spring 610 acts by its extension 691 directly on a finger 666 of the catch 606, and this under the effect of an effort $F_5$ exerted by a spring 630.

Under the effect of the effort exerted by a lateral face 692 of the extension 691, the catch 606 tips in the direction of arrow $F_8$ in FIG. 12, which has the effect of bringing its branch 661 into engagement with a toothing 689 provided on a ring 605 fixed with respect to the structure of the building and around which the ring 609 is mounted.

As previously, the catch 606 is received in a housing 603*a* made in the shaft 603 for winding the screen body T.

A spring 671 exerts on the catch 606 an elastic effort $F_3$ for moving the branch 661 away with respect to the toothing 689.

In the fifth and sixth forms of embodiment, the housings for receiving the catch may be obtained by assembling a plurality of parts together constituting the shaft 503 or 603.

Figure 14:
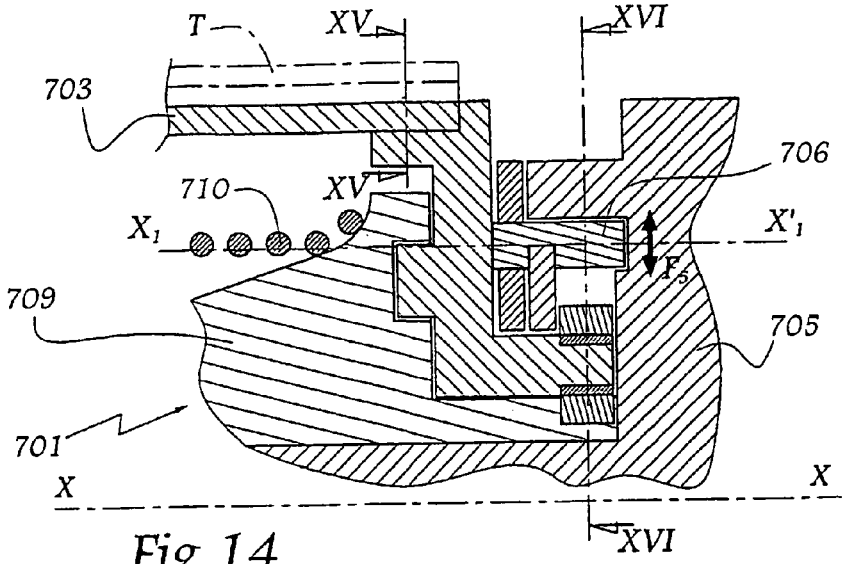
FIG. 14 is a section similar to FIG. 7 for a mechanism in accordance with a seventh embodiment of the invention.
Figure 15:
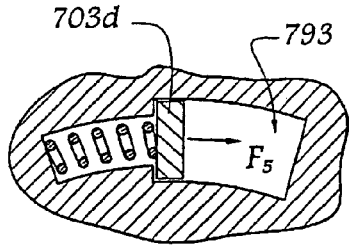
FIG. 15 is a section along line XV-XV in FIG. 14.
Figure 16:
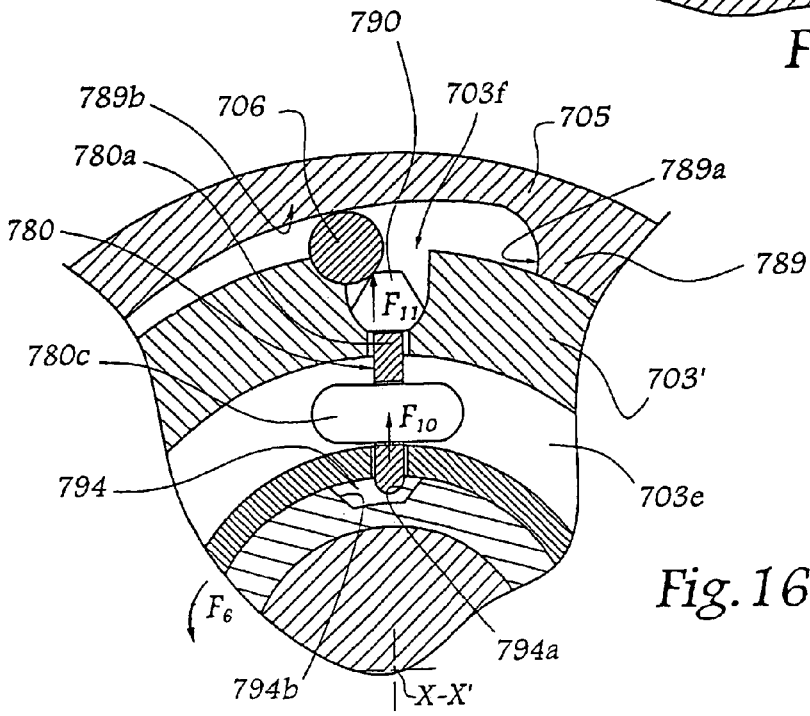
FIG. 16 is a section along line XVI-XVI in FIG. 14.

In the seventh form of embodiment of the invention shown in FIGS. 14 to 16, elements similar to those of the first embodiment bear identical references increased by 700. The mechanism 701 of this embodiment also comprises a ring 705 fixed with respect to the structure of a building as well as a ring 709 mounted to pivot about the ring 705 and fast in rotation with a compensating spring 710. A shaft 703 is provided for the controlled winding of a screen body T by its rotation about a substantially horizontal axis X-X'.

A plurality of oscillating catches are provided in this device in the manner described in EP-A-0 671 543, these catches, of which only one is shown in the Figures with reference 706, are of cylindrical shape, with circular cross-section and rectilinear generatrix and are capable of movement of radial oscillations with respect to axis X-X', in the direction of the double arrow $F_9$ in FIG. 14.

The catches 706 are provided to cooperate with a toothing 789 provided on the ring 705. A complementary toothing 790 is associated with the toothing 789 in order periodically to displace the catches 706 in the direction of the toothing 789, during rotation of the shaft 703.

An extension 703*d* is provided on the shaft 703 to extend inside a housing 793 made in the ring 709 and inside which is also disposed a spring 730 exerting on the extension 703*d* an effort $F_5$ directed towards the right in FIG. 15 and overcome by the torque exerted by the spring 710 when the installation is functioning normally. In the event of rupture of the spring 710, the effort $F_5$ displaces the extension 703*d* inside the housing 793, which has the effect of displacing the ring 709 in rotation with respect to the shaft 703, as represented by arrow $F_6$ in FIG. 16. A radial notch 794 is provided in the ring 709 while a shuttle 780 is installed in the housing 703*e* provided in a piece 703' fast with the shaft 703. The lateral faces 794*a* and 794*b* of the notch 794 are flared, this making it possible, during the displacement $F_6$, to exert on the shuttle 780 an effort $F_{10}$ which is centrifugal with respect to axis X-X' and having the effect of displacing the end 780*a* of the shuttle 780 radially towards the outside, this pushing the catch 706 radially in the direction of arrow $F_{11}$ and preventing a fresh introduction of a catch 706 in the housing 703*f* normally provided therefor in the shaft 703. In this way, the catch 706 comes into engagement with the toothing 789 and the mechanism is blocked in rotation.

In practice, a shuttle 780 is provided under each housing 703*f*. Furthermore, the ring 709 comprises a plurality of radial notches 794 corresponding to the different shuttles 780. In addition, the tooth of the toothing 789 visible in FIG. 16 is bordered by a part 789*a* of relatively small radius of curvature then by a part 789*b* shown partially in dashed and dotted lines in this Figure, this part approaching the ring 709 while moving away from part 789*a*, with the result that the catches disposed opposite the part 789*b* cannot leave their respective housings, no radial clearance being possible when the part 789*a* is adjacent the ring 709. This is why the two ends 780*a* and 180*b* of the shuttle 780 are connected by a blade 780*c* forming spring. In effect, in the case of rotation of the ring 709 with respect to the shaft 703, all the shuttles are stressed radially by the sides of the notches 794 and only the one which is disposed at the level of catch 706 opposite the part 789*a* may effectively be displaced. The other shuttles are compressed, by bringing together their ends 780*a* and 780*b* against the effort generated by the spring 780*c*.

The invention is not limited to the forms of embodiment described and the technical characteristics thereof may, in particular, be combined.

The invention has been described with a screen body T selectively windable around a shaft for closing an opening O. However, it is applicable whatever the nature of the closing means used, which may in particular be a rigid or semi-rigid panel controlled thanks to straps themselves wound on a shaft.

The invention claimed is:

1. A safety device for a closing installation comprising:

a mechanism for driving a screen body for selectively closing an opening, said mechanism including:

a shaft for winding and unwinding said screen body, an element having teeth, said element being mounted to said shaft, at least one catch which successively contacts said teeth and oscillates over said teeth of said element to permit rotational movements of said shaft as said screen body is being unwound, and a braking means for braking said at least one catch by preventing further oscillation of said at least one catch and causing said at least one catch to engage said teeth of said element in a non-oscillating manner to thereby cause said shaft to be immobilized, said braking means being controlled by a detection means for detecting a failure of a compensating means for compensating for a torque exerted on said shaft by said screen body, and said braking means having a shoe axially moveable along an axis (X-X') with respect to said shaft and adapted to come into abutment against said at least one catch.

2. The safety device according to claim 1, wherein said shoe has at least one first member, said at least one first member is adapted to cooperate with at least one corresponding second member of an annular ring that rotates with said compensating means for controlling the axial position of said shoe with respect to said at least one catch.

3. The safety device according to claim 2, wherein said at least one first member is a groove and said at least one second member is a rib that is engageable within said groove.

4. The safety device according to claim 2, wherein the at least one first member is formed on a tongue extending through an opening in said element that rotates with said shaft.

5. The safety device according to claim 2, wherein said shoe and said annular ring are disposed axially on either side of said element and kinematically connectable by said at least one first member and at least one second member.

6. The safety device according to claim 1, wherein said mechanism further includes means for applying an elastic force of displacement of said shoe toward said at least one catch.

7. The safety device according to claim 2, wherein said annular ring and said element have ribs between which at least one compression spring is disposed, said at least one compression spring exerts a rotational torque of said annular ring with respect to said element.

8. The safety device according to claim 1, wherein said mechanism includes a motor, and wherein said shoe is a ring disposed inside said shaft and around a support for said motor, said motor having an output that is drivingly connected to said shaft.

9. The safety device according to claim 1, wherein said braking means is adapted to displace said at least one catch toward a braked position.

10. The safety device according to claim 9, wherein said mechanism further includes a friction pellet mounted on said catch and adapted to receive said at least one catch in abutment.

11. The safety device according to claim 10, wherein said braking means has a surface formed on a ring that rotates with said compensating means and adapted to exert, directly or indirectly, a force of displacement on said at least one catch.

12. The safety device according to claim 11, wherein said surface extends in a direction substantially inclined with respect to an axis of rotation (X-X') of said shaft, said surface forming a ramp adapted to displace said at least one catch toward a braked position.

13. The safety device according to claim 11, wherein said surface is substantially radial with respect to an axis of rotation (X-X') of said shaft, said surface being adapted to cooperate with a finger of said at least one catch in order to tip said at least one catch about an axis of oscillation toward a braked position by engagement with said teeth.

14. The safety device according to claim 13, wherein said mechanism further includes means for returning said at least one catch from said braked position.

15. The safety device according to claim 9, wherein said braking means has at least one shuttle adapted to displace said at least one catch in a direction of fixed blocking teeth.

16. The safety device according to claim 15, wherein said shuttle has an elastic means for adjusting the length of the shuttle between a bearing surface and said at least one catch.

17. The safety device according to claim 9, wherein said mechanism further includes means for elastic return of said braking means toward a position in which said means exerts on said at least one catch a force of displacement toward said braked position.

18. The safety device according to claim 1, wherein said at least one catch is mounted on a fixed element of said installation.

19. The safety device according to claim 1, wherein said at least one catch is mounted on and adapted to be driven in rotation by an element that rotates with said shaft.

20. The safety device according to claim 1, wherein said braking means, said detection means, and said compensating means is arranged around a support for a motor of said mechanism.

21. The safety device according to claim 1, wherein said compensating means is a spring wound around an end support of said shaft, between a part fixed with respect to said support and an annular member adapted to rotate about said support as said support is driven by said shaft, said at least one catch being mounted to pivot about a pin fixed with respect to said support.

22. The safety device according to claim 1, wherein said compensating means is a spring that is compressed by a weight (P) and that rotates with an annular member surrounding an end support of said shaft, said at least one catch being mounted to pivot about a pin fixed with respect to said support.

23. The safety device according to claim 1, wherein said compensating means is a spring wound around a motor assembly disposed inside said shaft, said at least one catch being mounted to pivot about a pin fixed with respect to an end support of said shaft.

24. The safety device according to claim 1, wherein said compensating means is a spring within a spring box disposed inside said shaft, between said shaft and a fixed shaft, said spring box also contains said at least one catch, said braking means, and said detection means.

25. The safety device according to claim 1 wherein said shoe is a ring disposed inside said shaft and around a support and a motor assembly for said mechanism.

26. The safety device according to claim 9, wherein said mechanism further includes a friction pellet, mounted opposite said at least one catch, and adapted to come into contact with a bearing surface of said at least one catch.

27. The safety device according to claim 9, wherein said mechanism further includes means for elastic return of said braking means toward a position in which said means exerts on said at least one catch a force urging said at least one catch toward said braked position.

28. The safety device according to claim 1, wherein said braking means, said detection means, and said compensating means are arranged around a support and motor assembly for said mechanism.

29. A mechanism for moving a closing installation comprising:

a shaft for winding and unwinding a screen body;

an element having teeth, said element being mounted to said shaft;

at least one catch which successively contacts said teeth and oscillates over said teeth of said element to permit rotational movements of said shaft as said screen body is being unwound; and a braking means for braking said at least one catch by preventing further oscillation of said at least one catch and causing said at least one catch to engage said teeth of said element in a non-oscillating manner to thereby cause said shaft to be immobilized, said braking means being controlled by a detection means for detecting a failure of a compensating means for compensating for a torque exerted on said shaft by said screen body, and said braking means having a shoe axially moveable along an axis (X-X') with respect to said shaft and adapted to come into abutment against said at least one catch.

30. A safety device for a closing installation comprising:

a mechanism for driving a screen body for selectively closing an opening, said mechanism including:

a shaft for winding and unwinding said screen body, said shaft being capable of rotating in a first direction as the screen body is wound and capable of rotating in a second direction as the screen body in unwound, an element having teeth, said element being mounted to said shaft, at least one catch which successively contacts said teeth and oscillates over said teeth of said element as said shaft rotates in the second direction, and a braking means for braking said at least one catch by preventing further oscillation of said at least one catch and causing said at least one catch to engage said teeth of said element in a non-oscillating manner to thereby cause said shaft to be immobilized, said braking means being controlled by a detection means for detecting a failure of a compensating means for compensating for a torque exerted on said shaft by said screen body, and said braking means having a shoe axially moveable along an axis (X-X') with respect to said shaft and adapted to come into abutment against said at least one catch.

31. A closing installation comprising a screen body for selectively closing an opening and a safety device, said safety device including:

a shaft, said shaft being capable of rotating in a first direction as the screen body is wound and capable of rotating in a second direction as the screen body is unwound, an element having teeth, said element being mounted to said shaft, at least one catch which successively contacts said teeth and oscillates over said teeth of said element as said shaft rotates in the second direction, and a braking means for braking said at least one catch by preventing further oscillation of said at least one catch and causing said at least one catch to engage said teeth of said element in a non-oscillating manner to thereby cause said shaft to be immobilized, said braking means being controlled by a detection means for detecting a failure of a compensating means for compensating for a torque exerted on said shaft by said screen body, and said braking means having a shoe axially moveable along an axis (X-X') with respect to said shaft and adapted to come into abutment against said at least one catch.

32. A safety device for a closing installation comprising:

a mechanism for driving a screen body for selectively closing an opening, said mechanism including:

a shaft for winding and unwinding said screen body, an element having teeth, said element being mounted to said shaft, at least one catch which successively contacts said teeth and oscillates over said teeth of said element to permit rotational movements of said shaft as said screen body is being unwound, said at least one catch being mounted on a fixed element of said installation, and a braking means for braking said at least one catch by preventing further oscillation of said at least one catch and causing said at least one catch to engage said teeth of said element in a non-oscillating manner to thereby cause said shaft to be immobilized, said braking means being controlled by a detection means for detecting a failure of a compensating means for compensating for a torque exerted on said shaft by said screen body.

* * * * *